US009574445B2

(12) United States Patent
Yeu et al.

(10) Patent No.: US 9,574,445 B2
(45) Date of Patent: Feb. 21, 2017

(54) APPARATUS FOR BI-DIRECTIONALLY MINING MANGANESE NODULE

(71) Applicant: KOREA INSTITUTE OF OCEAN SCIENCE & TECHNOLOGY, Ansan-si, Gyeonggi-do (KR)

(72) Inventors: Tae-Kyeong Yeu, Daejeon (KR); Sup Hong, Daejeon (KR); Hyung-Woo Kim, Daejeon (KR); Jong-Su Choi, Daejeon (KR)

(73) Assignee: Korea Instutite of Ocean Science & Technology, Ansan-si (KR)

( * ) Notice: Subject to any disclaimer, the term of this patent is extended or adjusted under 35 U.S.C. 154(b) by 0 days.

(21) Appl. No.: 14/439,198

(22) PCT Filed: Oct. 4, 2013

(86) PCT No.: PCT/KR2013/008902
§ 371 (c)(1),
(2) Date: Apr. 28, 2015

(87) PCT Pub. No.: WO2014/069803
PCT Pub. Date: May 8, 2014

(65) Prior Publication Data

US 2015/0300167 A1 Oct. 22, 2015

(30) Foreign Application Priority Data

Oct. 30, 2012 (KR) ..... 10-2012-0121026

(51) Int. Cl.
*E21C 50/00* (2006.01)

(52) U.S. Cl.
CPC ..... *E21C 50/00* (2013.01)

(58) Field of Classification Search
CPC ..... E02F 3/8866; E02F 3/8858; E02F 3/907; E02F 3/18; E02F 5/006; E02F 5/109; E02F 7/06; E02F 7/005; E21C 25/00; E21C 50/00
(Continued)

(56) References Cited

U.S. PATENT DOCUMENTS 4,232,903 A * 11/1980 Welling ..... E02F 3/8858 241/1
4,685,742 A * 8/1987 Moreau ..... E02F 3/8858 299/8
(Continued)

FOREIGN PATENT DOCUMENTS

JP 6-17450 A 1/1994
JP 6-128984 A 5/1994
(Continued)

OTHER PUBLICATIONS

International Search Report, corresponding to PCT/KR2013/008902, dated Jan. 8, 2014, 4 pages.
(Continued)

*Primary Examiner* — Robert Pezzuto
(74) *Attorney, Agent, or Firm* — Lewis Roca Rothgerber Christie LLP

(57) ABSTRACT

An apparatus for bi-directionally mining a manganese nodule includes a traveling device to travel in a predetermined traveling direction, collecting devices installed at both ends of the traveling device, respectively, to collect the manganese nodule, and a control device to sense the traveling direction of the traveling device and to drive one of the collecting devices installed at both ends of the traveling device, which is placed in the sensed traveling direction.

6 Claims, 5 Drawing Sheets

(58) Field of Classification Search
USPC ..... 37/308, 310, 312, 314, 324, 343; 299/8, 299/9, 75; 241/1, 101.71, 301
See application file for complete search history.

(56) References Cited

U.S. PATENT DOCUMENTS

| | | | | |
|---|---|---|---|---|
| 5,328,250 | A * | 7/1994 | Upright | E21C 50/00 299/8 |
| 6,003,952 | A * | 12/1999 | Smart | E02F 5/006 299/75 |
| 9,243,496 | B2 * | 1/2016 | Jones | E02F 3/20 |
| 2006/0225771 | A1 | 10/2006 | Crawford, III et al. | |

FOREIGN PATENT DOCUMENTS

| | | | |
|---|---|---|---|
| JP | 7-252863 | A | 10/1995 |
| JP | 9-296477 | | 11/1997 |
| JP | 3144562 | | 3/2001 |
| KR | 10-0675601 | | 1/2007 |
| KR | 10-0795667 | | 1/2008 |
| KR | 10-2011-0067588 | | 6/2011 |
| WO | WO 98/51395 | | 11/1998 |
| WO | WO 99/07949 | | 2/1999 |
| WO | WO 2005/093215 | A1 | 10/2005 |
| WO | WO 2011/156866 | A1 | 12/2011 |

OTHER PUBLICATIONS

European Search Report dated Jun. 29, 2016 of the corresponding European Patent Application No. 13850747.0, noting listed references in this IDS (17 pages).

Melcher, P:, "Mathematische Modellbildung zur Befahrbarkeitssimulation einer mobilen Tiefsee-Arbeitsmaschine", Robotersysteme, vol. 4, No. 4, Nov. 1, 1988, pp. 209-222.

Japanese Office Action dated Apr. 12, 2016 of the corresponding Japanese Patent Application No. 2015-538011, noting listed references in this IDS (16 pages).

* cited by examiner

APPARATUS FOR BI-DIRECTIONALLY MINING MANGANESE NODULE

CROSS-REFERENCE TO RELATED APPLICATION(S)

This application is a National Phase Patent Application and claims priority to and benefit of International Application Number PCT/KR2013/008902, filed on Oct. 4, 2013, which claims priority to and benefit of Korean Patent Application Number 10-2012-0121026, filed on Oct. 30, 2012, the entire disclosures of which are incorporated herein by reference.

BACKGROUND OF THE INVENTION

1. Field of the Invention

The present invention relates to an apparatus for bi-directionally mining a manganese nodule, and more particularly, to an apparatus for bi-directionally mining a manganese nodule, capable of enhancing the collection efficiency of the manganese nodule by changing the operation of a collection device according to traveling directions 2. Description of the Related Art In general, a machine to mine a manganese nodule is placed on the bottom of a deep sea area in connection with a mother ship through a pipe riser to move while collecting the manganese nodule.

The mining machine includes a driving unit employing a caterpillar and a collecting unit installed in the driving unit to collect a manganese nodule existing on the seafloor.

The mining machine moves along the seafloor by the driving unit while forming predetermined ground pressure. In addition, the mining machine collects natural manganese nodules existing on the seafloor by the collecting unit.

There is a prior art registered with Korean Patent Registration No. 10-0795667. The prior art discloses a technology of increasing grounding pressure to more than a predetermined value when collecting nodules provided on a seafloor by a caterpillar vehicle divided into two tracks.

However, since the mining machine according to the prior art collects a manganese nodule by a collecting unit that is fixedly installed, the mining machine collects the manganese nodule by repeating forwarding-turning-forwarding operations. In particular, when the mining machine turns, the mining machine cannot collect the nodule. In addition, although the integrated system of a mother ship-pipe riser-mining machine must be accurately controlled, the accurate control of the integrated system may be rarely accomplished through existing technologies.

SUMMARY OF THE INVENTION

The present invention relates to an apparatus for bi-directionally mining a manganese nodule, capable of enhancing the collection efficiency of the manganese nodule since a turning operation is unnecessary and the accurate integral control is not required by changing the operation of a collecting device according to traveling directions.

According to one aspect of the present invention, there is provided an apparatus for bi-directionally mining a manganese nodule. The apparatus includes a traveling device to travel in a predetermined traveling direction, collecting devices installed at both ends of the traveling device, respectively, to collect the manganese nodule, and a control device to sense the traveling direction of the traveling device and to drive one of the collecting devices installed at both ends of the traveling device, which is placed in the sensed traveling direction.

According to another aspect of the present invention, there is provided an apparatus for bi-directionally mining a manganese nodule. The apparatus includes a traveling device to travel in a predetermined traveling direction, a collecting device to collect the manganese nodule, a rotating device installed in the traveling device to rotate the collecting device by receiving an electrical signal from an outside, and a control device to sense the traveling direction of the traveling device and to rotate the rotating device in the sensed traveling direction.

As described above, according to the present invention, the collection efficiency of the manganese nodule can be enhanced by changing the operation of a collection device according to traveling directions.

DETAILED DESCRIPTION OF THE INVENTION

Hereinafter, an apparatus for bi-directionally mining a manganese nodule according to the present invention will be described with reference to accompanying drawings.

First Embodiment

Figure 1:
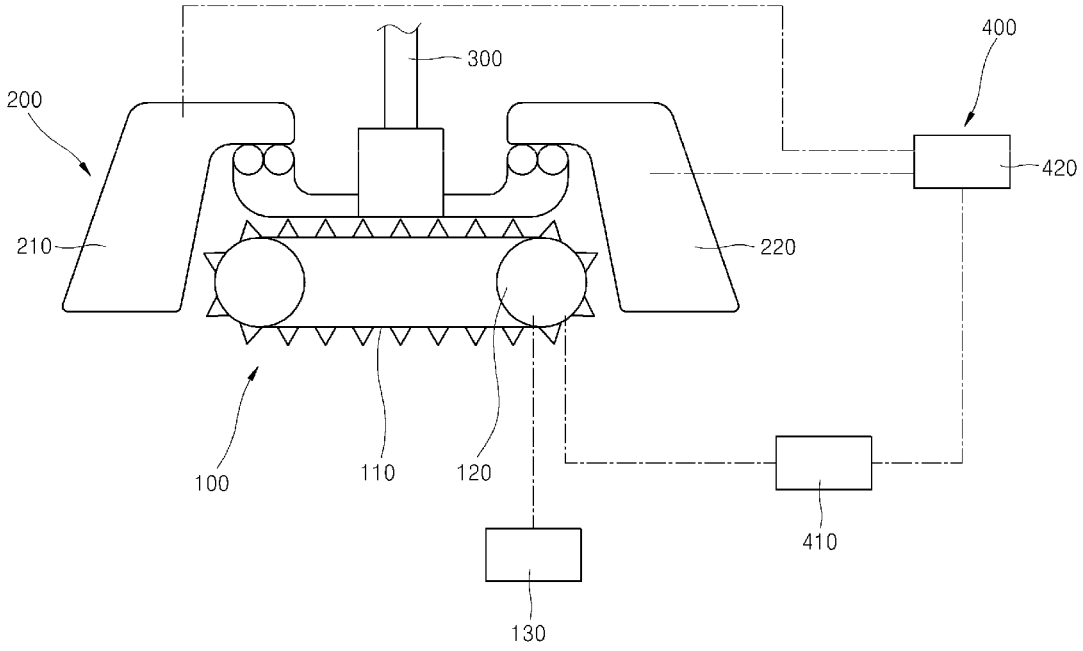
FIG. 1 is a view showing an apparatus for bi-directionally mining a manganese nodule according to a first embodiment of the present invention.
Figure 2:
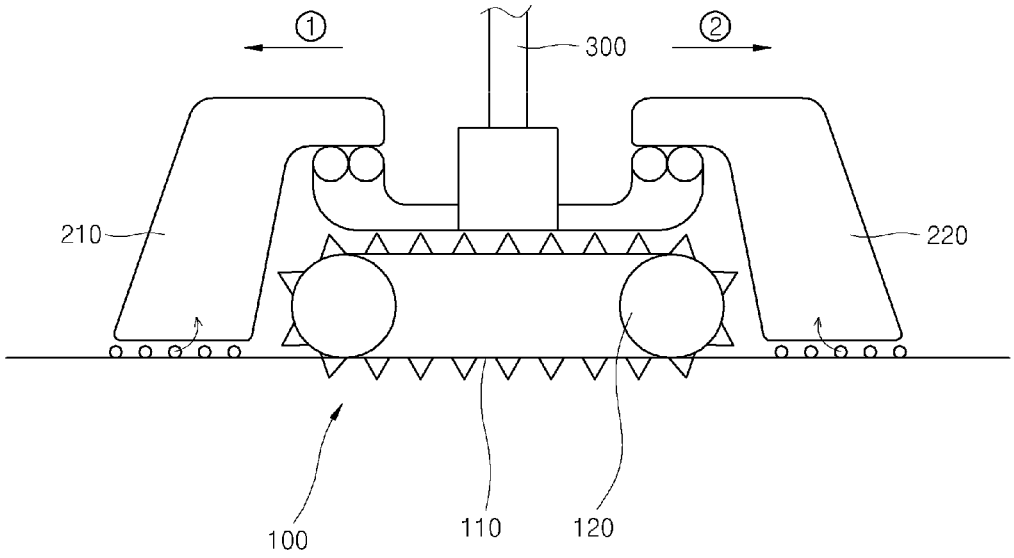
FIG. 2 is a view showing the operation of the apparatus for bi-directionally mining the manganese nodule shown in FIG. 1.

FIG. 1 is a view showing an apparatus for bi-directionally mining a manganese nodule according to a first embodiment of the present invention, and FIG. 2 is a view showing the operation of the apparatus for bi-directionally mining the manganese nodule shown in FIG. 1.

Referring to FIG. 1, the apparatus for bi-directionally mining the manganese nodule according to the present invention includes a traveling device 100, a collecting device 200, and a control device 400.

The traveling device 100 may travel in a predetermined traveling direction.

The traveling device 100 includes a caterpillar 110 and a traveling-driving unit 130.

The caterpillar 110 is locked to a sprocket 120. The sprocket 120 rotates by receiving power from the traveling-device unit 130.

The traveling-device unit 130 may decide a rotation direction of the sprocket 120 to rotate the sprocket 120.

The caterpillar 110 rotates due to the rotation of the sprocket 120.

Accordingly, the traveling device 100 may travel by rotating the caterpillar 110 in the state that the traveling device 100 is grounded on a seafloor.

The collecting device 200 collects a manganese nodule exiting on the seafloor through a lower end thereof to grind the manganese nodule in predetermined size.

The collecting device 200 includes first and second collecting devices 210 and 220 to be fixedly installed at front and rear ends of the traveling device 100, that is, both ends of the traveling device 100, respectively.

Although not shown in drawing, the manganese nodule ground by the collecting device 200 may be transmitted to the outside, that is, a mother ship through a transmitting device 300.

The control device 400 includes a sensing unit 410 and a driving unit 420.

The sensing unit 410 may serve as a sensor to sense the traveling direction of the traveling device 100.

The sensing unit 410 may sense the rotation direction of the sprocket 120, to which the caterpillar 110 is locked, to transmit a signal for the sensed rotation direction to the driving unit 420.

The driving unit 420 may drive one of the collecting devices 210 and 220 installed at both ends of the traveling device 100, respectively, which is placed in the sensed traveling direction.

In other words, the driving unit 420 may control the operation of each of the collecting devices 210 and 220 so that each of the collecting devices 210 and 220 may be turned on or off.

Referring to FIG. 2, when the traveling device 100 travels in a first traveling direction ① by the traveling-driving unit 130, the sensing unit 410 senses the rotation direction of the sprocket 120 rotating in the first traveling direction ① and transmits the signal for the sensed rotation direction to the driving unit 420.

Thereafter, the driving unit 420 may turn on the operation of the first collecting device 210 placed in the first traveling direction ① among the collecting devices of the collecting device 200 installed at both ends of the traveling device 100, and may turn off the operation of the second collecting device 220.

Reversely, when the traveling device 100 travels in a second traveling direction ②, the driving unit 420 may turn on the operation of the second collecting device 220 placed in the second traveling direction ② among the collecting devices installed at both ends of the traveling device 100, and may turn off the operation of the first collecting device 210.

Therefore, according to the first embodiment of the present invention, a pair of collecting devices, which are installed at both ends of the traveling device, respectively, are selectively operated according to the traveling directions of the traveling device by using the driving unit, so that the manganese nodule can be effectively collected regardless of the traveling directions of the traveling device.

Second Embodiment

Figure 3:
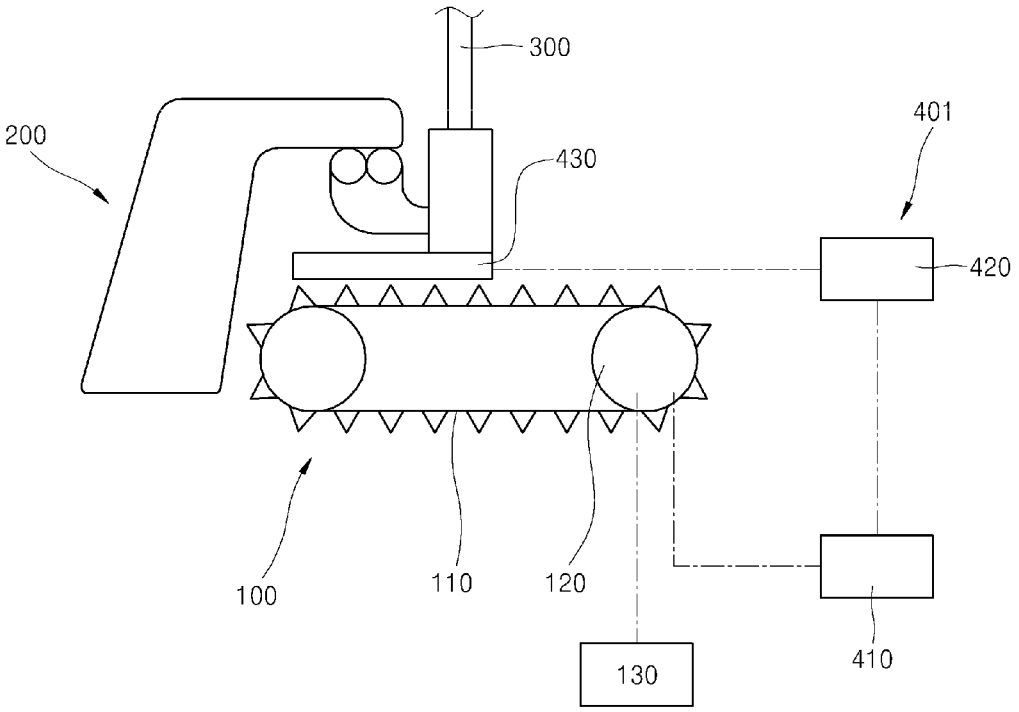
FIG. 3 is a view showing an apparatus for bi-directionally collecting a manganese nodule according to a second embodiment of the present invention.
Figure 4:
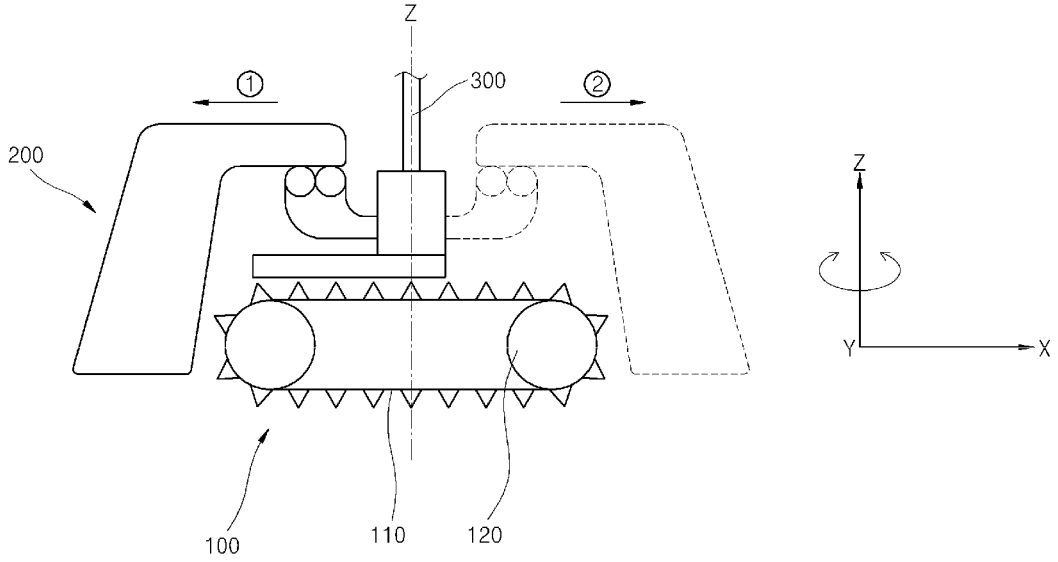
FIG. 4 is a view showing the operation of the apparatus for bi-directionally collecting the manganese nodule shown in FIG. 3.

FIG. 3 is a view showing an apparatus for bi-directionally collecting a manganese nodule according to a second embodiment of the present invention, and FIG. 4 is a view showing the operation of the apparatus for bi-directionally collecting the manganese nodule shown in FIG. 3.

Referring to FIG. 3, the apparatus for bi-directionally collecting the manganese nodule according to the present invention includes a traveling device 100, a rotating device 430, a collecting device 200, and a control device 401.

Since the traveling device 100 may have the same configuration as that of the embodiment described above, the details of the traveling device 100 may be omitted The rotating device 430 is installed at an upper end of the traveling device 100 and rotated by receiving an electrical signal from the control device 401.

The collecting device 200 is coupled to the rotating device 430 to be rotatable according to the rotation of the rotating device 430.

The rotating device 430 rotates the collecting device 200 about a Z axis.

One end of the collecting device 200 is coupled to the rotating device 430, and a lower end of the collecting device 200 extends to a front lower end of the traveling device 100 to collect the manganese nodule.

The control device 401 includes a sensing unit 410 and a driving unit 420.

The sensing unit 410 may be substantially identical to the sensing unit 410 according to the first embodiment described above. The sensing unit 410 senses the traveling direction of the traveling device 100, and transmits a signal for the sensed traveling direction to the driving unit 420.

The driving unit 420 is electrically connected with the rotating device 430. The driving unit 420 receives the signal for the traveling direction from the sensing unit 410 and rotates the rotating device 430 to place the collecting device 200 in the traveling direction.

Referring to FIG. 4, when the traveling device 100 travels in a first traveling direction ① by a traveling-driving unit 130, the sensing unit 410 senses the rotation direction of a sprocket 120 which is rotated in the first traveling-direction ① and transmits the sensed signal to the driving unit 420.

Thereafter, the driving unit 420 rotates the rotating device 430 so that the collecting device 200 is operated in the first traveling direction ①. In this case, preferably, the rotating device 430 is rotated by employing the Z axis as a rotation axis.

Reversely, when the traveling device 100 travels in a second direction ②, the driving unit 420 rotates the rotating device 430 so that the collecting device 200 is operated in the second traveling direction ②.

Therefore, according to the second embodiment of the present invention, one collecting device is rotated by the driving unit, so that the collecting device can be operated in real time in a traveling direction of the traveling device. Accordingly, manganese nodules can be efficiently collected regardless of the traveling direction of the traveling device without increasing the collecting device in number.

Third Embodiment

Figure 5:
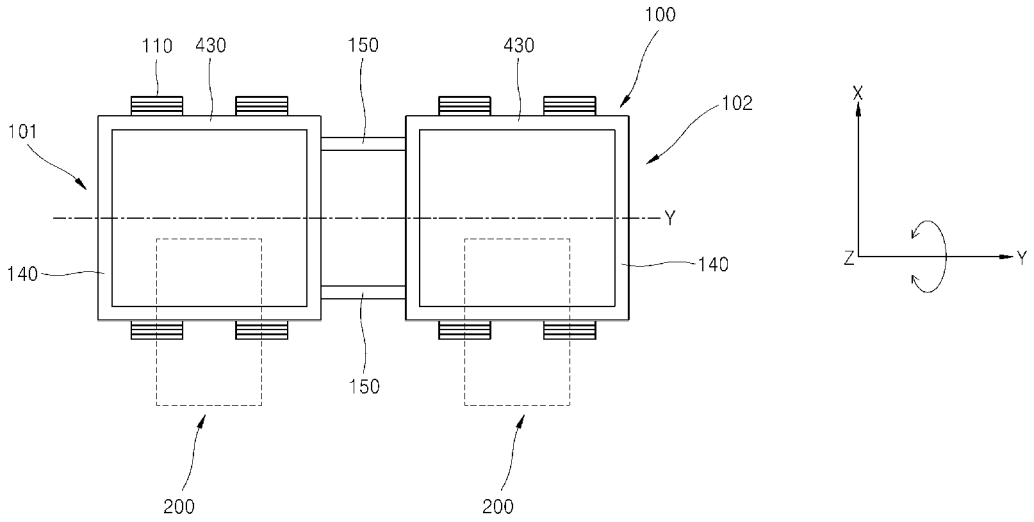
FIG. 5 is a view showing an apparatus for bi-directionally collecting a manganese nodule according to a third embodiment of the present invention.

FIG. 5 is a view showing an apparatus for bi-directionally mining a manganese nodule according to a third embodiment of the present invention.

Referring to FIG. 5, the apparatus for bi-directionally mining the manganese nodule according to the present invention includes a traveling device 100, a rotating device 430, a collecting device 200, and a control device 400 (see FIG. 2).

The traveling device 100 may include a plurality of traveling device bodies 101 and 102.

The traveling device bodies 101 and 102 include coupling frames 140, respectively, and the coupling frames 140 of the traveling device bodies 101 and 102 include coupling units 150, respectively, to couple the coupling frames 140 to each other in parallel.

The coupling units 150 may include units, such as bolts and nuts, to couple the coupling frames 140 to each other, and may include rail units to slidably couple the coupling frames 140 to each other. When the rail units are employed, fixing bolts may be further required to fix the coupling frames which are coupled to each other through a rail.

Rotating devices 430 are installed on upper ends of the traveling device bodies 101 and 102, respectively. Accordingly, the rotating devices 430 are provided in number corresponding to the number of the traveling device bodies 101 and 102.

In this case, the rotating devices 430 may be configured to be rotated about a Y axis.

Collecting devices 200 are coupled to the rotating devices 430, respectively. Accordingly, the collecting devices 200 are provided in number corresponding to the number of the rotating devices 430.

The rotating devices 430 receive an electrical signal from the control device 400 to rotate the collecting devices 200, respectively, about the Y axis.

The control device 400 includes a sensing unit 410 and a driving unit 420.

The sensing unit 410 may be substantially identical to the sensing unit according to the first or second embodiment described above. The sensing unit 420 senses the traveling direction of the traveling device 100 and transmits a signal for the sensed traveling direction to the driving unit 420.

The driving unit 420 is electrically connected with the rotating devices 430. The driving unit 420 receives the signal for the traveling direction from the sensing unit 410, and rotates the rotating devices 430 to rotate and place the collecting devices 200 so that the collecting devices 200 are operated in the traveling direction.

Referring to FIG. 5, when the traveling device 100 travels in a first traveling direction ① by the traveling-driving unit 130, the sensing unit 410 senses the rotation direction of the sprocket 120 rotated in the first traveling direction ① and transmits the sensed signal to the driving unit 420.

Thereafter, the driving unit 420 rotates the rotating devices 430 about the Y axis so that the collecting devices 200 are operated in the first traveling direction ①.

Therefore, each collecting device 200 may be rotated in a vertical direction of the traveling device 100.

Reversely, when the traveling device 100 travels in a second traveling direction ②, the driving unit 420 rotates the rotating devices 430 so that the collecting devices 200 are operated in the second traveling direction.

Therefore, according to the third embodiment of the present invention, a plurality of collecting devices are rotated in the vertical direction by the driving unit to be operated in real time in the traveling direction of the traveling device. Accordingly, when the traveling device bodies are coupled to each other in parallel, the collecting devices are rotated and placed in such a manner the rotations of the collecting devices do not interfere with each other, thereby efficiently collecting the manages nodules regardless of the traveling directions of the traveling device.

As described above, according to the present invention, the collection efficiency of the manganese nodule can be enhanced by changing the operation of the collecting device according to the traveling directions of the traveling device.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An apparatus for bi-directionally mining a manganese nodule, the apparatus comprising:

a traveling device to travel in a predetermined traveling direction;

collecting devices installed at both ends of the traveling device, respectively, to collect the manganese nodule; and a control device to sense the traveling direction of the traveling device and to drive one of the collecting devices installed at both ends of the traveling device, which is placed in the sensed traveling direction, wherein the traveling device includes a plurality of traveling device bodies, the traveling device bodies include coupling frames respectively, and the coupling frames include coupling units which comprise rail units to slidably couple the coupling frames to each other, respectively, to couple the coupling frames to each other in parallel.

2. An apparatus for bi-directionally mining a manganese nodule, the apparatus comprising:

a traveling device to travel in a predetermined traveling direction;

a collecting device to collect the manganese nodule;

a rotating device installed in the traveling device to rotate the collecting device by receiving an electrical signal from an outside; and a control device to sense the traveling direction of the traveling device and to rotate the rotating device in the sensed traveling direction, wherein the traveling device includes a plurality of traveling device bodies, the traveling device bodies include coupling frames respectively, and the coupling frames include coupling units which comprise rail units to slidably couple the coupling frames to each other, respectively, to couple the coupling frames to each other in parallel.

3. The apparatus of claim 1, wherein the control device comprises:

a sensing unit to sense the traveling direction of the traveling device; and a driving unit to drive one of the collecting devices installed at both ends of the traveling device, which is placed in the sensed traveling direction.

4. The apparatus of claim 2, wherein the control device comprises:

a sensing unit to detect the traveling direction of the traveling device; and a driving unit to place the collecting device by rotating the rotating device in the sensed traveling direction.

5. The apparatus of claim 4, wherein the traveling device comprises:

a caterpillar including a sprocket that is rotated; and a traveling-driving unit that rotates the sprocket by receiving an electrical signal from the outside to drive the caterpillar such that a traveling path is formed, and wherein the sensing unit senses a rotation direction of the sprocket to detect the traveling direction.

6. The apparatus of claim 4, wherein the rotating device is installed in the traveling device bodies, respectively, the collecting device is provided and coupled to the rotating device installed in the traveling device bodies, respectively, and the rotating device rotates the collecting device in a vertical direction, respectively.

* * * * *